US012007163B2

(12) United States Patent
Tang

(10) Patent No.: US 12,007,163 B2
(45) Date of Patent: Jun. 11, 2024

(54) REFRIGERATOR CALIBRATION METHOD AND SYSTEM, AND REFRIGERATOR

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventor: Xueqiang Tang, Anhui (CN)

(73) Assignees: HEFEI MIDEA REFRIGERATOR CO., LTD., Anhui (CN); HEFEI HUALING CO., LTD., Anhui (CN); MIDEA GROUP CO., LTD., Guangdong (CN)

( * ) Notice: Subject to any disclaimer, the term of this patent is extended or adjusted under 35 U.S.C. 154(b) by 547 days.

(21) Appl. No.: 17/296,168

(22) PCT Filed: Jun. 13, 2019

(86) PCT No.: PCT/CN2019/091041
§ 371 (c)(1),
(2) Date: May 21, 2021

(87) PCT Pub. No.: WO2020/248183
PCT Pub. Date: Dec. 17, 2020

(65) Prior Publication Data
US 2022/0018596 A1 Jan. 20, 2022

(51) Int. Cl.
*F25D 29/00* (2006.01)

(52) U.S. Cl.
CPC ..... *F25D 29/00* (2013.01); *F25D 2300/00* (2013.01)

(58) Field of Classification Search
CPC ..... F25D 21/006; F25D 2400/04; F25D 2700/12; F25D 21/02; F25B 2700/2117; F25B 2600/112; F25B 2400/01
See application file for complete search history.

(56) References Cited

U.S. PATENT DOCUMENTS 7,681,406 B2 3/2010 Cushman et al.
8,484,987 B2 7/2013 Ducharme et al.
(Continued)

FOREIGN PATENT DOCUMENTS

CN 1382949 A 12/2002
CN 100374799 C 3/2008
(Continued)

OTHER PUBLICATIONS

European Office Action, dated Dec. 7, 2021, for European Application No. 19908244.7, 11 pages.
(Continued)

*Primary Examiner* — Nelson J Nieves
*Assistant Examiner* — Meraj A Shaikh
(74) *Attorney, Agent, or Firm* — Seed IP Law Group LLP

(57) ABSTRACT

A refrigerator calibration method and system, and a refrigeration device is described. According to some embodiments of the refrigerator calibration method, by means of the variation in the temperatures of a plurality of compartments after any one refrigeration system operates for a predetermined time, a correlation between the refrigeration system and a compartment can be determined, such that a connection between the refrigeration system and the compartment does not need to be pre-specified. Therefore, a refrigerator being unable to perform normal refrigeration due to a connection error during a production process can be effectively avoided, and the probability of needing to repair the refrigerator is reduced, thereby improving the production efficiency of the refrigerator and the reliability of the refrigerator.

11 Claims, 4 Drawing Sheets

(56) References Cited

U.S. PATENT DOCUMENTS

| | | | |
|---|---|---|---|
| 2008/0072610 | A1 | 3/2008 | Venkatakrishnan et al. |
| 2008/0190125 | A1 | 8/2008 | Yoshioka et al. |
| 2013/0025303 | A1 | 1/2013 | Yoon et al. |
| 2017/0336916 | A1* | 11/2017 | Lee ..... G06F 3/04842 |
| 2018/0283758 | A1 | 10/2018 | Ding et al. |
| 2018/0328642 | A1 | 11/2018 | McCollough et al. |

FOREIGN PATENT DOCUMENTS

| | | | |
|---|---|---|---|
| CN | 102767929 | A | 11/2012 |
| CN | 103017392 | A | 4/2013 |
| CN | 107289712 | A | 10/2017 |
| CN | 109405411 | A | 3/2019 |
| EP | 1182389 | A1 | 2/2002 |
| EP | 2 401 564 | A2 | 1/2012 |
| JP | H08261627 | A | 10/1996 |
| JP | 2000292046 | A | 10/2000 |
| JP | 2001221555 | A | 8/2001 |
| JP | 2002022336 | A * | 1/2002 |
| JP | 2002022336 | A | 1/2002 |
| JP | 2002-156177 | A | 5/2002 |
| JP | 3545617 | B2 | 7/2004 |
| WO | WO 2010099439 | A2 | 9/2010 |

OTHER PUBLICATIONS

European Office Action, dated Dec. 7, 2021, for European Application No. 19908593.7, 11 pages.

Office Action, dated Jul. 7, 2022, for Australian Patent Application No. 2019421618. (5 pages).

Office Action, dated Oct. 18, 2022, for Canadian Patent Application No. 3,126,296. (4 pages).

Office Action, dated Oct. 12, 2023, for European Patent Application No. 18 945 188.3. (9 pages).

International Search Report dated Mar. 9, 2020 for PCT Application No. PCT/CN2019/091041, pp. 6.

Australian Office Action, mailed Apr. 20, 2022 for Australian Application No. 2019418359, 3 pages.

* cited by examiner

REFRIGERATOR CALIBRATION METHOD AND SYSTEM, AND REFRIGERATOR

BACKGROUND

Technical Field

The present disclosure relates to a field of refrigeration devices, and more particularly to calibration method and system for a refrigerator, and a refrigerator.

Description of the Related Art

Refrigerators are developing in the direction of large volume and multiple functions, and the refrigeration system of the refrigerators is also developing from a single system to a multi-system. For example, for a refrigerator with a tri-refrigeration system, three capillary tubes and an electromagnetic valve with one inlet and three outlets are commonly used. After the three outlet tubes of the electromagnetic valve and the three capillary tubes are connected to each other, the valve body may turn on a capillary according to the step number of the electromagnetic valve as predetermined. When refrigeration is requested for a refrigerating compartment, a freezing compartment or a variable temperature compartment of the refrigerator, the electromagnetic valve will operate in accordance with the preset control rules to cool each compartment. Before the refrigerator is sent out from the factory, the three outlet tubes of the valve body and three capillaries will be marked, for example in color, according to the preset rules. During production, the outlet tube and the capillary tube having the same color mark may be connected and welded.

However, the outlet tube and the capillary tube may be mismatched due to faded marks during transportation or carelessness of an assembler. In this case, the refrigerator is abnormal in the refrigeration performances, and will be sent back for maintenance, resulting in decrease in productivity and increase in cost of the refrigerator manufacture.

BRIEF SUMMARY

The present disclosure seeks to solve at least one of the problems existing in the related art to at least some extent.

Accordingly, an object of the present disclosure is to provide a calibration method for a refrigerator, which is capable of effectively avoiding connection errors (such as a reverse welding connection) in the production process that may cause abnormal refrigeration of the refrigerator, and reducing the probability of the refrigerator being repaired, thereby improving the production efficiency and the reliability of the refrigerator.

A second object of the present disclosure is to provide a calibration system for a refrigerator.

A third object of the present disclosure is to provide a non-temporary computer-readable storage medium.

A fourth object of the present disclosure is to provide a refrigeration device.

In order to achieve the above object, the present disclosure provides in embodiments of a first aspect a calibration method for a refrigerator. The refrigerator includes a plurality of compartments and a plurality of refrigeration systems for cooling the plurality of compartments in a one-to-one correspondence. The calibration method includes: starting a compressor of the refrigerator, and detecting temperatures of the plurality of compartments; controlling a first refrigeration system of the plurality of refrigeration systems to operate for a first predetermined time, and detecting the temperatures of the plurality of compartments for a second time; and determining, according to temperature variations of the plurality of compartments, a correspondence between the first refrigeration system and a first compartment of the plurality of compartments.

With the calibration method for the refrigerator of the present disclosure, the correspondence between the refrigeration system and the compartment may be determined according to the temperature variations of the compartments after any of the refrigeration systems is running for the predetermined time. There is no need to preset the connection between the refrigeration system and the compartment. Therefore, connection errors (such as a reverse welding connection) in the production process that may cause abnormal refrigeration of the refrigerator may be effectively avoided, and the probability of the refrigerator being repaired may be reduced, thereby improving the production efficiency and the reliability of the refrigerator.

In some embodiments, the calibration method further includes: controlling a second refrigeration system of the plurality of refrigeration systems to operate for a second predetermined time, and detecting the temperatures of the plurality of compartments for a third time; determining, according to temperature variations of the plurality of compartments, a correspondence between the second refrigeration system and a second compartment of the plurality of compartments; after correspondences between the plurality of refrigeration systems and the plurality of compartments are determined, calibrating the refrigerator according to the correspondences between the plurality of refrigeration systems and the plurality of compartments.

In some embodiments, the calibration method further includes: restarting the compressor of the refrigerator to control the first refrigeration system of the plurality of refrigeration systems to operate; determining whether a temperature of the first compartment is changed after a third predetermined time; determining that the correspondence between the first refrigeration system and the first compartment of the plurality of compartments is correct if the temperature of the first compartment is changed; and correcting the calibration if the temperature of the first compartment is not changed.

In some embodiments, correcting the calibration if the temperature of the first compartment is not changed includes: if a temperature of the second compartment is changed, changing the correspondence of the first refrigeration system with the first compartment into with the second compartment, changing the correspondence of the second refrigeration system with the second compartment into with the first compartment, and correcting the calibration.

In some embodiments, after correcting the calibration, the calibration method further includes: controlling the second refrigeration system of the plurality of refrigeration systems to operate; determining whether the temperature of the first compartment is changed after a fourth predetermined time; and determining that the corrected calibration is correct if the temperature of the first compartment is changed; otherwise, determining that the refrigerator is abnormal.

The present disclosure provides in embodiments of a second aspect a calibration system for a refrigerator. The refrigerator includes a plurality of compartments and a plurality of refrigeration systems for cooling the plurality of compartments in a one-to-one correspondence. The calibration system includes: a detecting module, configured to detect temperatures of the plurality of compartments after a compressor of the refrigerator is started, and detect the temperatures of the plurality of compartments for a second time after a first refrigeration system of the plurality of refrigeration systems operates for a first predetermined time; and a control module, configured to control the first refrigeration system of the plurality of refrigeration systems to operate, and determine, according to temperature variations of the plurality of compartments, a correspondence between the first refrigeration system and a first compartment of the plurality of compartments.

With the calibration system for the refrigerator of the present disclosure, the correspondence between the refrigeration system and the compartment may be determined according to the temperature variations of the compartments after any of the refrigeration systems is running for the predetermined time. There is no need to preset the connection between the refrigeration system and the compartment. Therefore, connection errors (such as a reverse welding connection) in the production process that may cause abnormal refrigeration of the refrigerator may be effectively avoided, and the probability of the refrigerator being repaired may be reduced, thereby improving the production efficiency and the reliability of the refrigerator.

In some embodiments, the detecting module is further configured to detect the temperatures of the plurality of compartments for a third time after a second refrigeration system of the plurality of refrigeration systems operates for a second predetermined time. The control module is further configured to control the second refrigeration system of the plurality of refrigeration systems to operate, determine, according to temperature variations of the plurality of compartments, a correspondence between the second refrigeration system and a second compartment of the plurality of compartments, and after correspondences between the plurality of refrigeration systems and the plurality of compartments are determined, calibrate the refrigerator according to the correspondences between the plurality of refrigeration systems and the plurality of compartments.

In some embodiments, the control module is further configured to restart the compressor of the refrigerator to control the first refrigeration system of the plurality of refrigeration systems to operate, determine whether a temperature of the first compartment is changed after a third predetermined time, determine that the correspondence between the first refrigeration system and the first compartment of the plurality of compartments is correct if the temperature of the first compartment is changed, and correct the calibration if the temperature of the first compartment is not changed.

In some embodiments, if the temperature of the first compartment is not changed, the control module is further configured to determine whether a temperature of the second compartment is changed, if the temperature of the second compartment is changed, change the correspondence of the first refrigeration system with the first compartment into with the second compartment, change the correspondence of the second refrigeration system with the second compartment into with the first compartment, and correct the calibration.

In some embodiments, after the calibration is corrected, the control module is further configured to control the second refrigeration system of the plurality of refrigeration systems to operate, determine whether the temperature of the first compartment is changed after a fourth predetermined time, and determine that the corrected calibration is correct if the temperature of the first compartment is changed, otherwise, determining that the refrigerator is abnormal.

The present disclosure provides in embodiments of a third aspect a non-temporary computer-readable storage medium having stored therein a calibration program for a refrigerator, when executed by a processor, causes the processor to perform the calibration method for the refrigerator as above described in the embodiments of the first aspect.

The present disclosure provides in embodiments of a fourth aspect a refrigeration device, including: a processor, a memory have stored therein a calibration program for a refrigerator that, when executed by the processor, causes the processor to perform the calibration method for the refrigerator as above described in the embodiments of the first aspect. With the calibration device of the present disclosure, the correspondence between the refrigeration system and the compartment may be determined according to the temperature variations of the compartments after any of the refrigeration systems is running for the predetermined time. There is no need to preset the connection between the refrigeration system and the compartment. Therefore, connection errors (such as a reverse welding connection) in the production process that may cause abnormal refrigeration of the refrigerator may be effectively avoided, and the probability of the refrigerator being repaired may be reduced, thereby improving the production efficiency and the reliability of the refrigerator.

In some embodiments, the refrigeration device includes a refrigerator.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE SEVERAL VIEWS OF THE DRAWINGS

These and other aspects and advantages of embodiments of the present disclosure will become apparent and more readily appreciated from the following descriptions made with reference to the drawings, in which.

DETAILED DESCRIPTION

Figure 1:
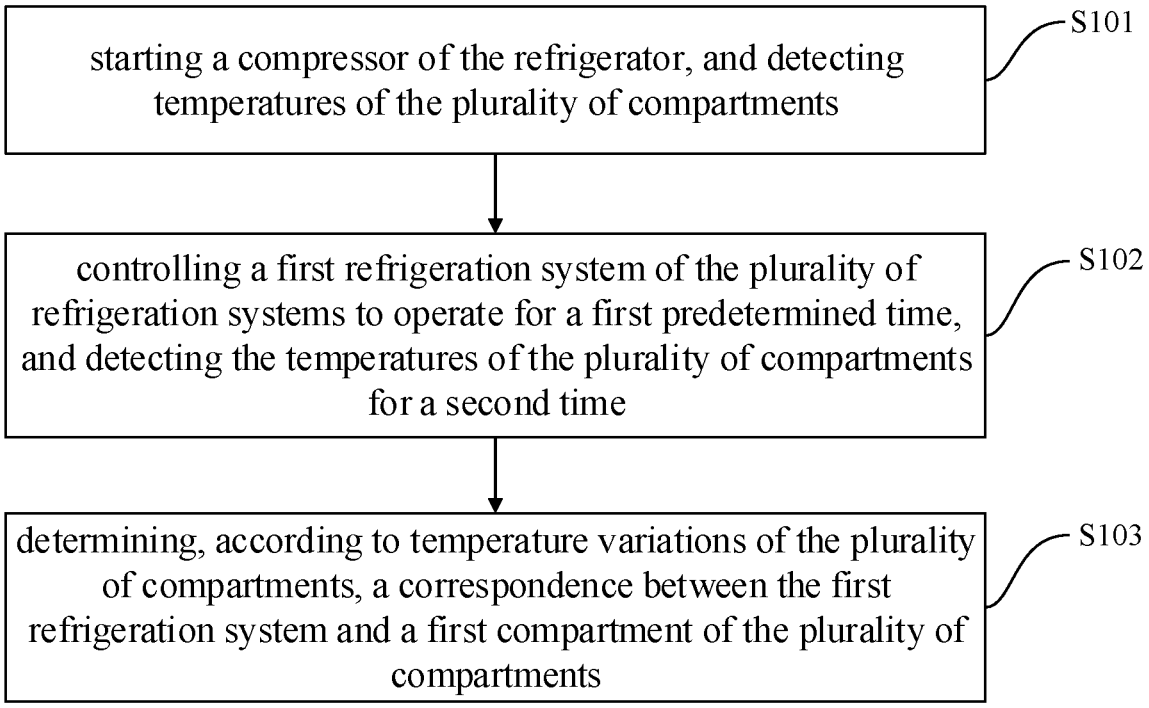
FIG. 1 is a flow chart of a calibration method for a refrigerator according to an embodiment of the present disclosure.

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

With reference to the drawings, a calibration method and a calibration system for a refrigerator as well as a refrigeration device according to the embodiments of the present disclosure are described as follows. Before describing the calibration method/system for the refrigerator and refrigeration device according to the embodiments of the present disclosure, the refrigerator is first described. The refrigerator includes a plurality of compartments and a plurality of refrigeration systems for cooling the plurality of compartments in a one-to-one correspondence.

For example, a dual-system refrigerator includes two compartments, e.g., a refrigerating compartment and a freezing compartment, and two refrigeration systems. One refrigeration system is configured to cool the refrigerating compartment and the other refrigeration system is configured to cool the freezing compartment. Inlets of throttling devices (such as capillary tubes) of the two refrigeration systems are respectively connected to outlets of a valve body. The valve body includes an inlet and two outlets. When one of the refrigeration systems is running, the valve body connects the inlet to the corresponding outlet.

The refrigerator may be a tri-system refrigerator including three compartments, e.g., a refrigerating compartment, a freezing compartment and a variable temperature compartment, and three refrigeration systems. One of the refrigeration systems is configured to cool the refrigerating compartment, another one of the refrigeration systems is configured to cool the freezing compartment and the remaining one of the refrigeration systems is configured to cool the variable temperature compartment. Inlets of throttling devices (such as capillary tubes) of the three refrigeration systems are respectively connected to outlets of a valve body. The valve body includes an inlet and three outlets. When one of the refrigeration systems is running, the valve body connects the inlet to the corresponding outlet.

For the tri-system refrigerator, the valve body is, for example, an electromagnetic valve with one inlet and three outlets. The three outlets of the electromagnetic valve are connected to the three capillary tubes in a one-to-one correspondence, a refrigeration system will be initiated according to a preset relationship between the step number of the electromagnetic valve and a corresponding turned-on outlet of the valve body. For example, when the refrigerating compartment, the freezing compartment or the variable temperature compartment requests refrigeration, the electromagnetic valve is adjusted to a step number which is preset to achieve the purpose of cooling the corresponding compartment.

FIG. 1 is a flow chart of a calibration method for a refrigerator according to an embodiment of the present disclosure. As shown in FIG. 1, the calibration method for the refrigerator includes operations as follows.

In S101, a compressor of the refrigerator is started, and temperatures of the plurality of compartments are detected. The refrigerator being started refers to that the refrigerator is powered on, and the refrigeration is performed. At this time, the compressor is started, and the refrigeration system of the refrigerator is running.

Figure 2:
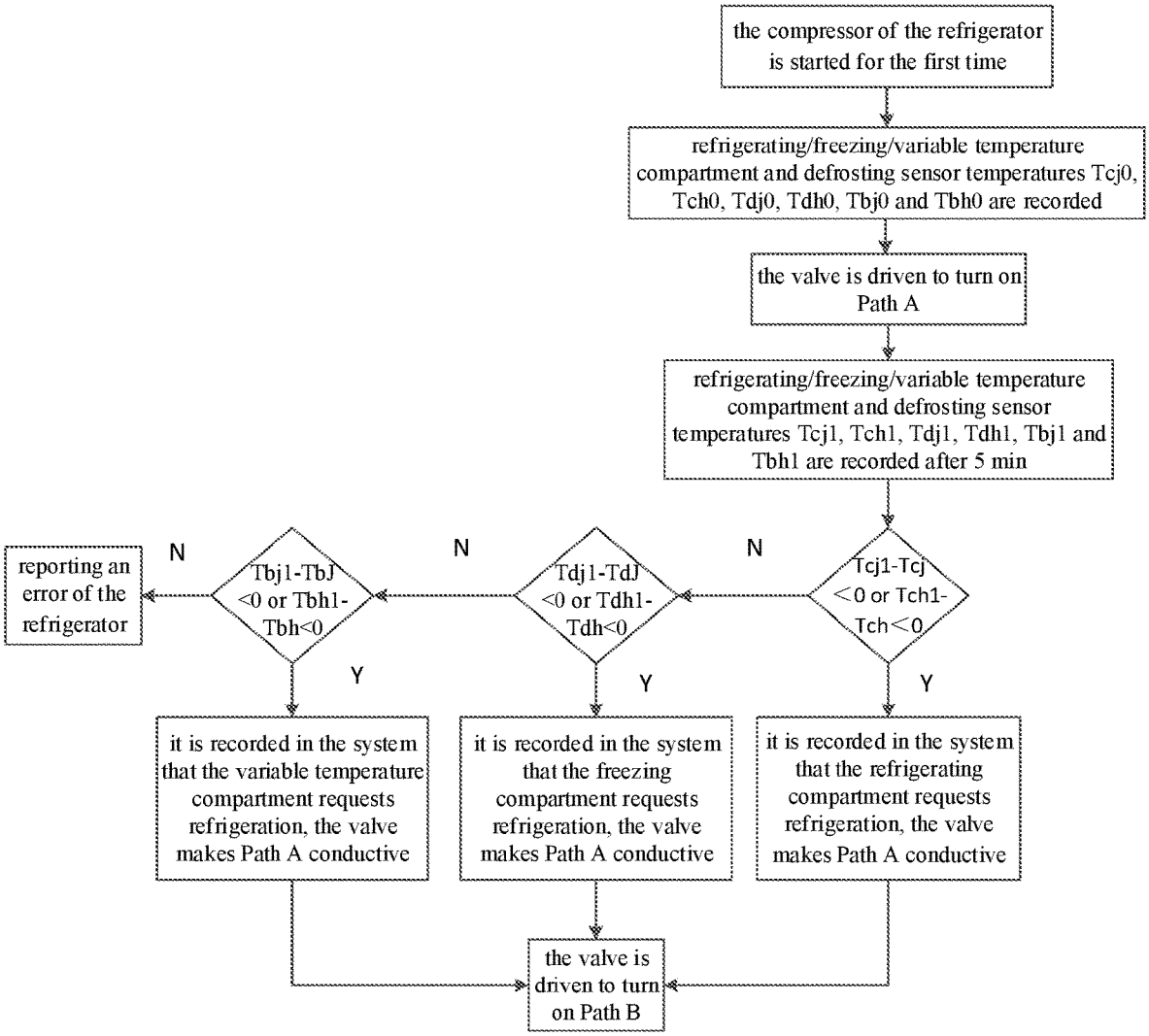
FIG. 2 is a flow chart of a calibration method for a refrigerator according to another embodiment of the present disclosure.

For example, the refrigerator may be a tri-system refrigerator as shown in FIG. 2. When the refrigerator is powered on for the first time, that is, the compressor of the refrigerator is started for the first time, recorded are refrigerating compartment and defrosting sensor temperatures Tcj0 (e.g., a refrigerating compartment temperature) and Tch0 (e.g., a defrosting sensor temperature of the refrigerating compartment), freezing compartment and defrosting sensor temperatures Tdj0 (e.g., a freezing compartment temperature) and Tdh0 (e.g., a defrosting sensor temperature of the freezing compartment), and variable temperature compartment and defrosting sensor temperatures Tbj0 (e.g., a variable temperature compartment temperature) and Tbh0 (e.g., a defrosting sensor temperature of the variable temperature compartment).

In a specific embodiment, each temperature may be detected by a corresponding temperature sensor.

In S102, a first refrigeration system of the plurality of refrigeration systems is controlled to operate for a first predetermined time, and the temperatures of the plurality of compartments are detected for a second time.

For example, the first predetermined time may be 5 min, and the first refrigeration system may be any one of the three refrigeration systems.

For example, the electromagnetic valve is adjusted to a predetermined step number, and Path A corresponding to a refrigeration system is built and conductive. After 5 min, the refrigerating compartment and defrosting sensor temperatures Tcj1 and Tch1, the freezing compartment and defrosting sensor temperatures Tdj1 and Tdh1, and variable temperature compartment and defrosting sensor temperatures Tbj1 and Tbh1 are recorded.

In S103, a correspondence between the first refrigeration system and a first compartment of the plurality of compartments is determined according to temperature variations of the plurality of compartments.

That is, when Path A is conductive, the compartment where the refrigeration happens may be determined by comparing the temperatures related to different compartment. For example, when Path A is conductive and the refrigerating compartment and defrosting sensor temperatures are changed, it can be determined that the refrigeration system allowing a circuit flowing through Path A corresponds to the refrigerating compartment. Specifically, when Path A is conductive for 5 min and Tcj1−Tcj0 (also known as Tcj)<0 or Tch1−Tch0 (as shown as Tch)<0, it is recorded that the refrigerating compartment requests refrigeration, the valve (e.g., the electromagnetic valve) makes Path A conductive (e.g., as a circuit).

Still referring to FIG. 2, when the Path A is conductive, and the variable temperature compartment and defrosting sensor temperatures are changed, it can be determined that the refrigeration system allowing a circuit flowing through Path A corresponds to the variable temperature compartment. As shown in FIG. 2, it is recorded that the variable temperature compartment requests refrigeration, the valve (e.g., the electromagnetic valve) makes Path A conductive (e.g., as a circuit). When Path A is conductive, and the freezing compartment and defrosting sensor temperatures are changed, it can be determined that the refrigeration system allowing a circuit flowing through Path A corresponds to the freezing compartment. As shown in FIG. 2, it is recorded that the freezing compartment requests refrigeration, the valve (e.g., the electromagnetic valve) makes Path A conductive (e.g., as a circuit).

Further, a second refrigeration system of the plurality of refrigeration systems is controlled to operate for a second predetermined time, and the temperatures of the plurality of compartments are detected for a third time. A correspondence between the second refrigeration system and a second compartment of the plurality of compartments is determined according to temperature variations of the plurality of compartments. After correspondences between the plurality of refrigeration systems and the plurality of compartments are determined, the refrigerator is calibrated according to the correspondences between the plurality of refrigeration systems and the plurality of compartments.

In other words, S102 and S103 are performed repeatedly until it is determined that Path B and Path C, which are built as circuits by the electromagnetic valve, correspond to the remaining two compartments, respectively.

With the calibration method for the refrigerator of the present disclosure, the correspondence between the refrigeration system and the compartment may be determined according to the temperature variations of the compartments after any of the refrigeration systems is running for the predetermined time. There is no need to preset the connection between the refrigeration system and the compartment. Therefore, connection errors (such as a reverse welding connection) in the production process that may cause abnormal refrigeration of the refrigerator may be effectively avoided, and the probability of the refrigerator being repaired may be reduced, thereby improving the production efficiency and the reliability of the refrigerator.

Further, the above calibration may be verified, to improve the pass rate of the refrigerators after leaving the factory. Specifically, the calibration method further includes the following operations. The compressor of the refrigerator is restarted, e.g., the refrigerator is powered on again, to perform the refrigeration. At this time, the compressor is restarted, to allow the refrigeration system of the refrigerator to operate and to control the first refrigeration system of the plurality of refrigeration systems to operate. It is determined whether a temperature of the first compartment is changed after a third predetermined time. If the temperature of the first compartment is changed, it is determined that the correspondence between the first refrigeration system and the first compartment of the plurality of compartments is correct; and if the temperature of the first compartment is not changed, the calibration is corrected.

Further, correcting the calibration includes: if a temperature of the second compartment is changed, changing the correspondence of the first refrigeration system with the first compartment into with the second compartment, changing the correspondence of the second refrigeration system with the second compartment into with the first compartment, and correcting the calibration.

In addition, after correcting the calibration, the method further includes: controlling the second refrigeration system of the plurality of refrigeration systems to operate; determining whether the temperature of the first compartment is changed after a fourth predetermined time; and determining that the corrected calibration is correct if the temperature of the first compartment is changed; otherwise, determining that the refrigerator is abnormal.

It should be noted that the first, second, third and fourth predetermined times may be different or the same, for example, all of them may be 5 min.

Figure 3A:
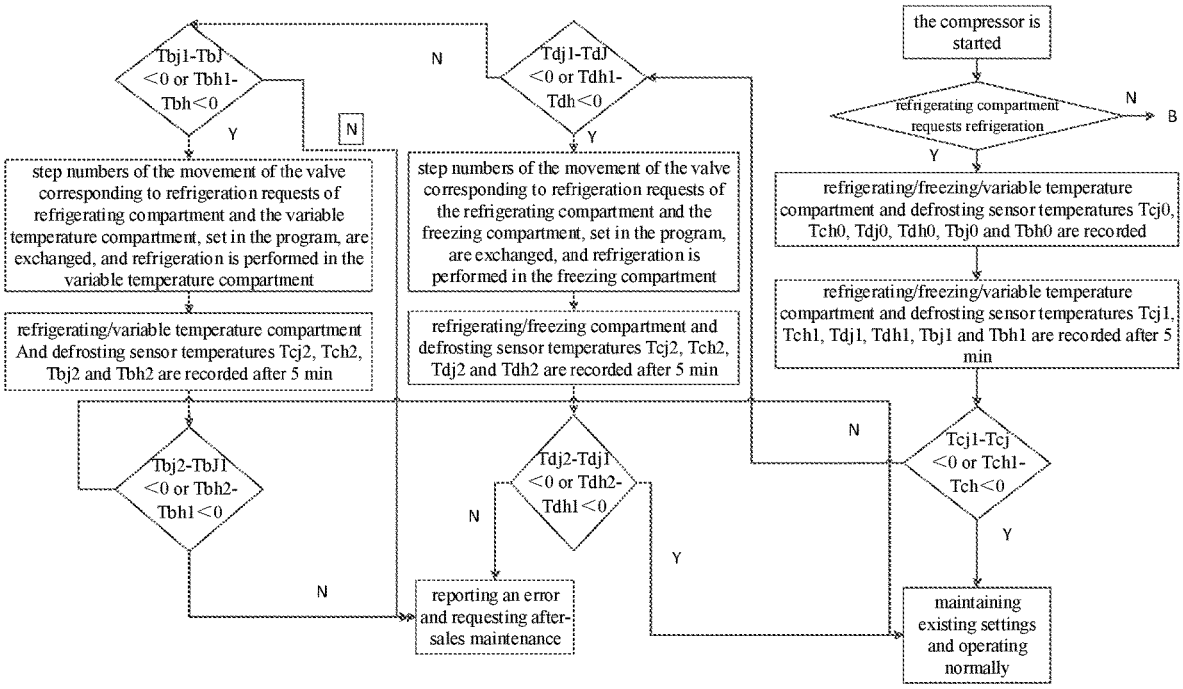
FIGS. 3A-3C are each a flow chart verifying calibration of a refrigerating compartment, a freezing compartment or a variable temperature compartment with the present calibration method according to an embodiment of the present disclosure.
Figure 3B:
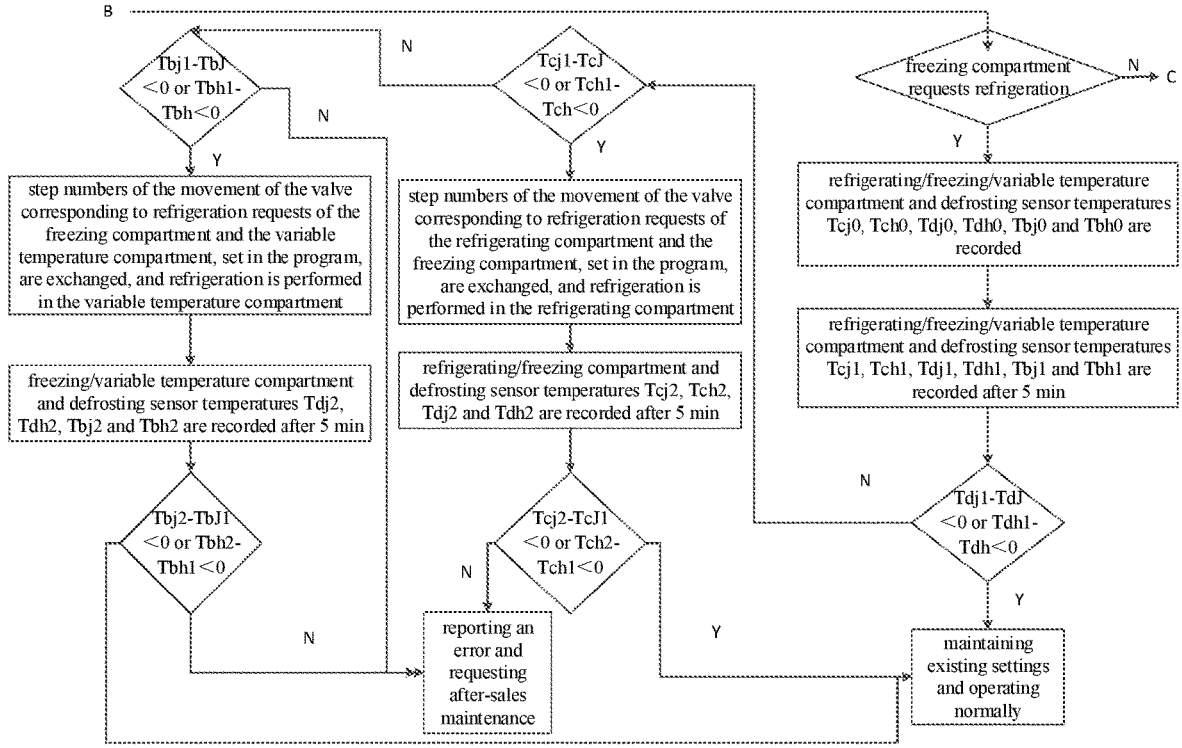
Figure 3C:
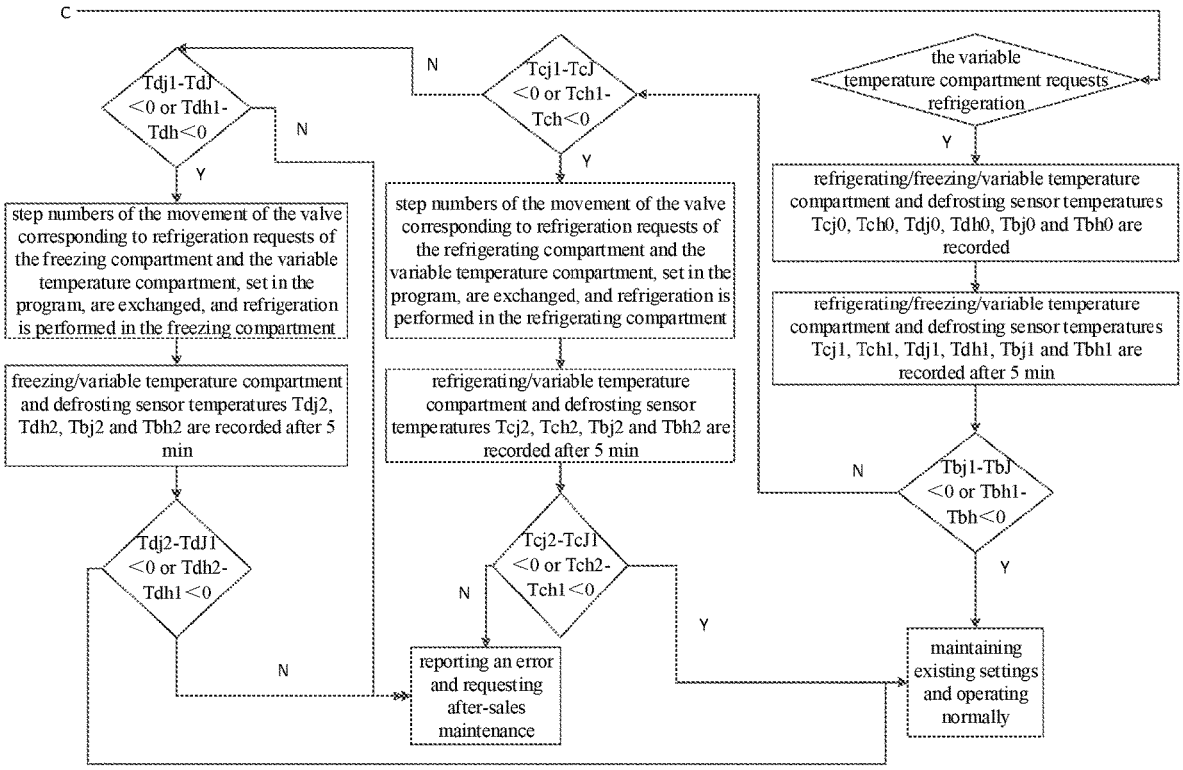

For example, the refrigerator may be a tri-system refrigerator. As shown in FIG. 3A-3C, when the compressor of the refrigerator is restarted after first shutdown, the calibration may be verified as follows.

According to the calibration, one of the refrigeration systems is turned on and the corresponding compartment is recorded. At the same time, the refrigerating compartment and defrosting sensor temperatures Tcj and Tch, the freezing compartment and defrosting sensor temperatures Tdj and Tdh, and variable temperature compartment and defrosting sensor temperatures Tbj and Tbh are recorded. After 5 min, the refrigerating compartment and defrosting sensor temperatures Tcj1 and Tch1, the freezing compartment and defrosting sensor temperatures Tdj1 and Tdh1, and variable temperature compartment and defrosting sensor temperatures Tbj1 and Tbh1 are recorded. Through the comparisons of the requests and the temperature variations of the compartments, it can be determined whether the current connection between the capillary and the electromagnetic valve is consistent with the calibration obtained above.

As shown in FIG. 3A, when the refrigerating compartment requests the refrigeration for the first time, after the refrigeration is performed for 5 min, if Tcj1−Tcj<0 or Tch1−Tch<0, the current connection for the capillary is correct, no adjustment is required, and the refrigerator operates normally.

If Tdj1−Tdj<0 or Tdh1−Tdh<0, Tcj1−Tcj>0 and Tch1−Tch>0, Tbj1−Tbj>0 and Tbh1−Tbh>0 after 5 min, the current connection between the capillary and the electromagnetic valve is wrong, and the calibrated step numbers of the movement of the electromagnetic valve for the refrigerating compartment and the freezing compartment should be exchanged. After this, the freezing compartment is controlled to be cooled for 5 min, the refrigerating compartment and defrosting sensor temperatures Tcj2 and Tch2, and the freezing compartment and defrosting sensor temperatures Tdj2 and Tdh2 are recorded. If Tdj2−Tdj1<0 or Tdh2−Tdh1<0, it is determined that the corrected calibration is correct, otherwise, it is determined that the refrigerator is abnormal and an error is reported.

If Tbj1−Tbj<0 or Tbh1−Tbh<0, Tcj1−Tcj>0 and Tch1−Tch>0, Tdj1−Tdj>0 and Tdh1−Tdh>0, after 5 min, the current connection between the capillary and the electromagnetic valve is wrong, and the calibrated step numbers of the movement of the electromagnetic valve for the refrigerating compartment and the variable temperature compartment should be exchanged. After this, the variable temperature compartment is controlled to be cooled for 5 min, the refrigerating compartment and defrosting sensor temperatures Tcj2 and Tch2, and variable temperature compartment and defrosting sensor temperatures Tbj2 and Tbh2 are recorded. If Tbj2−Tbj1<0 or Tbh2−Tbh1<0, it is determined that the corrected calibration is correct, otherwise, it is determined that the refrigerator is abnormal and an error is reported.

As shown in FIG. 3B, when the freezing compartment requests the refrigeration for the first time, after the refrigeration is performed for 5 min, if Tdj1−Tdj<0 or Tdh1−Tdh<0, the current connection for the capillary is correct, no adjustment is required, and the refrigerator operates normally.

If Tcj1−Tcj<0 or Tch1−Tch<0, Tdj1−Tdj>0 and Tdh1−Tdh>0, Tbj1−Tbj>0 and Tbh1−Tbh>0 after 5 min, the current connection between the capillary and the electromagnetic valve is wrong, and the calibrated step numbers of the movement of the electromagnetic valve for the refrigerating compartment and the freezing compartment should be exchanged. After this, the refrigerating compartment is controlled to be cooled for 5 min, the refrigerating compartment and defrosting sensor temperatures Tcj2 and Tch2, and the freezing compartment and defrosting sensor temperatures Tdj2 and Tdh2 are recorded. If Tcj2−Tcj1<0 or Tch2−Tch1<0, it is determined that the corrected calibration is correct, otherwise, it is determined that the refrigerator is abnormal and an error is reported.

If Tbj1−Tbj<0 or Tbh1−Tbh<0, Tcj1−Tcj>0 and Tch1−Tch>0, Tdj1−Tdj>0 and Tdh1−Tdh>0, after 5 min, the current connection between the capillary and the electromagnetic valve is wrong, and the calibrated step numbers of the movement of the electromagnetic valve for the freezing compartment and the variable temperature compartment should be exchanged. After this, the variable temperature compartment is controlled to be cooled for 5 min, the freezing compartment and defrosting sensor temperatures Tdj2 and Tdh2, and variable temperature compartment and defrosting sensor temperatures Tbj2 and Tbh2 are recorded. If Tbj2−Tbj1<0 or Tbh2−Tbh1<0, a corresponding new rule is kept, otherwise, it is determined that the refrigerator is abnormal and an error is reported. The user may wait for after-sales person for maintenance.

As shown in FIG. 3C, when the variable temperature compartment requests the refrigeration for the first time, after the refrigeration is performed for 5 min, if Tbj1−Tbj<0 or Tbh1−Tbh<0, the current connection for the capillary is correct, no adjustment is required, and the refrigerator operates normally.

If Tcj1−Tcj<0 or Tch1−Tch<0, Tdj1−Tdj>0 and Tdh1−Tdh>0, Tbj1−Tbj>0 and Tbh1−Tbh>0 after 5 min, the current connection between the capillary and the electromagnetic valve is wrong, and the calibrated step numbers of the movement of the electromagnetic valve for the refrigerating compartment and the variable temperature compartment should be exchanged. After this, the refrigerating compartment is controlled to be cooled for 5 min, the refrigerating compartment and defrosting sensor temperatures Tcj2 and Tch2, and variable temperature compartment and defrosting sensor temperatures Tbj2 and Tbh2 are recorded. If Tcj2−Tcj1<0 or Tch2−Tch1<0, a corresponding new rule is kept, otherwise, it is determined that the refrigerator is abnormal and an error is reported. The user may wait for after-sales person for maintenance.

If Tdj1−Tdj<0 or Tdh1−Tdh<0, Tcj1−Tcj>0 and Tch1−Tch>0, Tbj1−Tbj>0 and Tbh1−Tbh>0, after 5 min, the current connection between the capillary and the electromagnetic valve is wrong, and the calibrated step numbers of the movement of the electromagnetic valve for the freezing compartment and the variable temperature compartment should be exchanged. After this, the freezing compartment is controlled to be cooled for 5 min, the freezing compartment and defrosting sensor temperatures Tdj2 and Tdh2, and variable temperature compartment and defrosting sensor temperatures Tbj2 and Tbh2 are recorded. If Tdj2−Tdj1<0 or Tdh2−Tdh1<0, it is determined that the corrected calibration is correct, otherwise, it is determined that the refrigerator is abnormal and an error is reported.

Further, the method can be re-executed every 12 hours afterwards and after every defrosting. In this way, it can effectively avoid the abnormality of the refrigerator caused by transmission errors of the control signal of the electromagnetic valve or other failures and improve the reliability of the operation of the refrigerator.

With the calibration method for the refrigerator of the present disclosure, the correspondence between the refrigeration system and the compartment may be determined according to the temperature variations of the compartments after any of the refrigeration systems is running for the predetermined time. There is no need to preset the connection between the refrigeration system and the compartment. Therefore, connection errors (such as a reverse welding connection) in the production process that may cause abnormal refrigeration of the refrigerator may be effectively avoided, and the probability of the refrigerator being repaired may be reduced, thereby improving the production efficiency. In addition, there is no need to mark the connection assembly in advance, which reduces the operations for the production of parts and the whole machine, and thus reduces the production cost.

Figure 4:
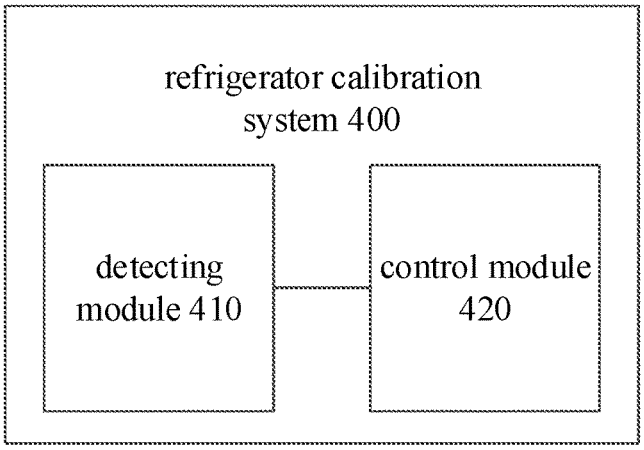
FIG. 4 is a block diagram of a calibration system for a refrigerator according to an embodiment of the present disclosure.

FIG. 4 is a block diagram of a calibration system for a refrigerator according to an embodiment of the present disclosure. As shown in FIG. 4, the calibration system 400 for a refrigerator according to an embodiment of the present disclosure includes a detecting module 410 and a control module 420.

The detecting module 410 is configured to detect temperatures of the plurality of compartments after a compressor of the refrigerator is started, and detect the temperatures of the plurality of compartments for a second time after a first refrigeration system of the plurality of refrigeration systems operates for a first predetermined time. The control module 420 is configured to control the first refrigeration system of the plurality of refrigeration systems to operate, and determine, according to temperature variations of the plurality of compartments, a correspondence between the first refrigeration system and a first compartment of the plurality of compartments.

In an embodiment of the present disclosure, the detecting module 410 is further configured to detect the temperatures of the plurality of compartments for a third time after a second refrigeration system of the plurality of refrigeration systems operates for a second predetermined time. The control module 420 is further configured to control the second refrigeration system of the plurality of refrigeration systems to operate, determine, according to temperature variations of the plurality of compartments, a correspondence between the second refrigeration system and a second compartment of the plurality of compartments, and after correspondences between the plurality of refrigeration systems and the plurality of compartments are determined, calibrate the refrigerator according to the correspondences between the plurality of refrigeration systems and the plurality of compartments.

In an embodiment of the present disclosure, the control module 420 is further configured to restart the compressor of the refrigerator to control the first refrigeration system of the plurality of refrigeration systems to operate, determine whether a temperature of the first compartment is changed after a third predetermined time, determine that the correspondence between the first refrigeration system and the first compartment of the plurality of compartments is correct if the temperature of the first compartment is changed, and correct the calibration if the temperature of the first compartment is not changed.

In an embodiment of the present disclosure, if the temperature of the first compartment is not changed, the control module 420 is further configured to determine whether a temperature of the second compartment is changed, if the temperature of the second compartment is changed, change the correspondence of the first refrigeration system with the first compartment into with the second compartment, change the correspondence of the second refrigeration system with the second compartment into with the first compartment, and correct the calibration.

In an embodiment of the present disclosure, after the calibration is corrected, the control module 420 is further configured to control the second refrigeration system of the plurality of refrigeration systems to operate, determine whether the temperature of the first compartment is changed after a fourth predetermined time, and determine that the corrected calibration is correct if the temperature of the first compartment is changed, otherwise, determining that the refrigerator is abnormal.

With the calibration system for the refrigerator of the present disclosure, the correspondence between the refrigeration system and the compartment may be determined according to the temperature variations of the compartments after any of the refrigeration systems is running for the predetermined time. There is no need to preset the connection between the refrigeration system and the compartment. Therefore, connection errors (such as a reverse welding connection) in the production process that may cause abnormal refrigeration of the refrigerator may be effectively avoided, and the probability of the refrigerator being repaired may be reduced, thereby improving the production efficiency. In addition, there is no need to mark the connection assembly in advance, which reduces the operations for the production of parts and the whole machine, and thus reduces the production cost.

It should be noted that details for specific implementations of the calibration system for the refrigerator of the embodiments of the present disclosure may refer to the description of the specific embodiments of the calibration method for the refrigerator since the implementations of the system and the method are similar, and thus will not be described again here.

Furthermore, the present disclosure provides in embodiments a non-temporary computer-readable storage medium having stored therein a calibration program for a refrigerator, when executed by a processor, causes the processor to perform the calibration method for the refrigerator according to any above embodiment.

Furthermore, the present disclosure provides in embodiments a refrigeration device, including: a processor, a memory have stored therein a calibration program for a refrigerator that, when executed by the processor, causes the processor to perform the calibration method for the refrigerator according to any above embodiment. For example, the refrigeration device is a refrigerator.

With the calibration device of the present disclosure, the correspondence between the refrigeration system and the compartment may be determined according to the temperature variations of the compartments after any of the refrigeration systems is running for the predetermined time. There is no need to preset the connection between the refrigeration system and the compartment. Therefore, connection errors (such as a reverse welding connection) in the production process that may cause abnormal refrigeration of the refrigerator may be effectively avoided, and the probability of the refrigerator being repaired may be reduced, thereby improving the production efficiency. In addition, there is no need to mark the connection assembly in advance, which reduces the operations for the production of parts and the whole machine, and thus reduces the production cost.

In addition, other configurations and functions of the refrigeration device according to the embodiments of the present disclosure are known to those skilled in the art, and details of which are not described herein for avoid redundancy.

It will be understood that, the flow chart or any process or method described herein in other manners may represent a module, segment, or portion of code that includes one or more executable instructions to implement the specified logic function(s) or that includes one or more executable instructions of the steps of the progress. Although the flow chart shows a specific order of execution, it is understood that the order of execution may differ from that which is depicted. For example, the order of execution of two or more blocks may be scrambled relative to the order shown.

The logic and/or step described in other manners herein or shown in the flow chart, for example, a particular sequence table of executable instructions for realizing the logical function, may be specifically achieved in any computer-readable medium to be used by the instruction execution system, device or equipment (such as the system based on computers, the system including processors or other systems capable of obtaining the instruction from the instruction execution system, device and equipment and executing the instruction), or to be used in combination with the instruction execution system, device and equipment. As to the specification, "computer-readable medium" may be any device adaptive for including, storing, communicating, propagating or transferring programs to be used by or in combination with the instruction execution system, device or equipment. More specific examples of the computer-readable medium include but are not limited to: an electronic connection (an electronic device) with one or more wires, a portable computer enclosure (a magnetic device), a random access memory (RAM), a read only memory (ROM), an erasable programmable read-only memory (EPROM or a flash memory), an optical fiber device and a portable compact disk read-only memory (CDROM). In addition, the computer-readable medium may even be a paper or other appropriate medium capable of printing programs thereon, this is because, for example, the paper or other appropriate medium may be optically scanned and then edited, decrypted or processed with other appropriate methods when necessary to obtain the programs in an electric manner, and then the programs may be stored in the computer memories.

It should be understood that each part of the present disclosure may be realized by the hardware, software, firmware or their combination. In the above embodiments, a plurality of operations or methods may be realized by the software or firmware stored in the memory and executed by the appropriate instruction execution system. For example, if it is realized by the hardware, likewise in another embodiment, the steps or methods may be realized by one or a combination of the following techniques known in the art: a discrete logic circuit having a logic gate circuit for realizing a logic function of a data signal, an application-specific integrated circuit having an appropriate combination logic gate circuit, a programmable gate array (PGA), a field programmable gate array (FPGA), etc.

Those skilled in the art shall understand that all or parts of the steps in the above exemplifying method of the present disclosure may be achieved by commanding the related hardware with programs. The programs may be stored in a computer-readable storage medium, and the programs include one or a combination of the operations in the method embodiments of the present disclosure when run on a computer.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Therefore, the appearances of the above phrases throughout this specification are not necessarily referring to the same embodiment or example of the present disclosure. Furthermore, the particular features, structures, materials, or characteristics, which are not contradict each other, may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

The various embodiments described above can be combined to provide further embodiments. All of the U.S.

patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A calibration method for a refrigerator including a compressor, a plurality of compartments and a plurality of refrigeration systems for cooling the plurality of compartments in a one-to-one correspondence, the calibration method comprising:

starting the compressor of the refrigerator, and detecting temperatures of the plurality of compartments;

controlling a first refrigeration system of the plurality of refrigeration systems to operate for a first predetermined time, and detecting the temperatures of the plurality of compartments for a second time;

determining, based on temperature variations of the plurality of compartments, a correspondence between the first refrigeration system and a first compartment of the plurality of compartments;

controlling a second refrigeration system of the plurality of refrigeration systems to operate for a second predetermined time, and detecting the temperatures of the plurality of compartments for a third time;

determining, based on temperature variations of the plurality of compartments, a correspondence between the second refrigeration system and a second compartment of the plurality of compartments; and after correspondences between the plurality of refrigeration systems and the plurality of compartments are determined, calibrating the refrigerator based on the correspondences between the plurality of refrigeration systems and the plurality of compartments.

2. The calibration method according to claim 1, further comprising:

restarting the compressor of the refrigerator to control the first refrigeration system of the plurality of refrigeration systems to operate;

determining whether a temperature of the first compartment is changed after a third predetermined time;

determining that the correspondence between the first refrigeration system and the first compartment of the plurality of compartments is correct if the temperature of the first compartment is changed; and correcting the calibration if the temperature of the first compartment is not changed.

3. The calibration method according to claim 2, wherein correcting the calibration if the temperature of the first compartment is not changed comprises:

if a temperature of the second compartment is changed, changing the correspondence of the first refrigeration system with the first compartment into with the second compartment, changing the correspondence of the second refrigeration system with the second compartment into with the first compartment, and correcting the calibration.

4. The calibration method according to claim 3, after correcting the calibration, further comprising:

controlling the second refrigeration system of the plurality of refrigeration systems to operate;

determining whether the temperature of the first compartment is changed after a fourth predetermined time; and determining that the corrected calibration is correct if the temperature of the first compartment is changed, otherwise, determining that the refrigerator is abnormal.

5. A calibration system for a refrigerator including a compressor, a plurality of compartments and a plurality of refrigeration systems for cooling the plurality of compartments in a one-to-one correspondence, the calibration system comprising:

a detecting module, configured to detect temperatures of the plurality of compartments after the compressor of the refrigerator is started, and detect the temperatures of the plurality of compartments for a second time after a first refrigeration system of the plurality of refrigeration systems operates for a first predetermined time; and a control module, configured to control the first refrigeration system of the plurality of refrigeration systems to operate, and determine, based on temperature variations of the plurality of compartments, a correspondence between the first refrigeration system and a first compartment of the plurality of compartments, wherein the detecting module is further configured to detect the temperatures of the plurality of compartments for a third time after a second refrigeration system of the plurality of refrigeration systems operates for a second predetermined time; and wherein the control module is further configured to:

control the second refrigeration system of the plurality of refrigeration systems to operate;

determine, based on temperature variations of the plurality of compartments, a correspondence between the second refrigeration system and a second compartment of the plurality of compartments; and after correspondences between the plurality of refrigeration systems and the plurality of compartments are determined, calibrate the refrigerator based on the correspondences between the plurality of refrigeration systems and the plurality of compartments.

6. A calibration system for a refrigerator including a compressor, a plurality of compartments and a plurality of refrigeration systems for cooling the plurality of compartments in a one-to-one correspondence, the calibration system comprising:

a detecting module, configured to detect temperatures of the plurality of compartments after the compressor of the refrigerator is started and detect the temperatures of the plurality of compartments for a second time after a first refrigeration system of the plurality of refrigeration systems operates for a first predetermined time; and a control module configured to control the first refrigeration system of the plurality of refrigeration systems to operate, and determine, based on temperature variations of the plurality of compartments, a correspondence between the first refrigeration system and a first compartment of the plurality of compartments, wherein the control module is further configured to:

restart the compressor of the refrigerator to control the first refrigeration system of the plurality of refrigeration systems to operate;

determine whether a temperature of the first compartment is changed after a third predetermined time;

determine that the correspondence between the first refrigeration system and the first compartment of the plurality of compartments is correct if the temperature of the first compartment is changed; and correct the calibration if the temperature of the first compartment is not changed.

7. The calibration system according to claim 6, wherein if the temperature of the first compartment is not changed, the control module is further configured to:

determine whether a temperature of the second compartment is changed, if the temperature of the second compartment is changed, change the correspondence of the first refrigeration system with the first compartment into with the second compartment, change the correspondence of the second refrigeration system with the second compartment into with the first compartment, and correct the calibration.

8. The calibration system according to claim 7, after the calibration is corrected, the control module is further configured to:

control the second refrigeration system of the plurality of refrigeration systems to operate;

determine whether the temperature of the first compartment is changed after a fourth predetermined time; and determine that the corrected calibration is correct if the temperature of the first compartment is changed, otherwise, determining that the refrigerator is abnormal.

9. A non-temporary computer-readable storage medium having stored therein a calibration program for a refrigerator, when executed by a processor, causes the processor to perform the calibration method for the refrigerator according to claim 1.

10. A refrigeration device, comprising:

a processor; and a memory have stored therein a calibration program for a refrigerator that, when executed by the processor, causes the processor to perform the calibration method for the refrigerator according to claim 1.

11. The refrigeration device according to claim 10, wherein the refrigeration device includes a refrigerator.

* * * * *